United States Patent [19]

Salam

[11] Patent Number: 4,983,956

[45] Date of Patent: Jan. 8, 1991

[54] DISPLAY ARRANGEMENT

[75] Inventor: Hassan P. A. Salam, London, England

[73] Assignee: Unisplay S.A., Geneva, Switzerland

[21] Appl. No.: 256,590

[22] Filed: Oct. 13, 1988

[51] Int. Cl.[5] ..... G09G 3/34

[52] U.S. Cl. ..... 340/783; 340/815.1; 340/815.27

[58] Field of Search ..... 340/752, 764, 783, 815.1, 340/815.17, 815.24, 815.27, 702; 358/58; 40/463, 452, 531, 449

[56] References Cited

U.S. PATENT DOCUMENTS 4,163,332 8/1979 Salam ..... 340/783
4,742,632 5/1988 Salam ..... 340/815.24
4,819,357 4/1989 Salam ..... 340/783

*Primary Examiner*—Jeffery A. Brier
*Attorney, Agent, or Firm*—Laubscher, Presta & Laubscher

[57] ABSTRACT

A display having a matrix of back-illuminated electromagnetically operated pixels. The display may be switched, by means of a movable light-passing sheet, between first and second modes of operation. In the first mode, the display is monochromatic and has a high resolution. In the second mode, color images are displayed but at a lower resolution.

4 Claims, 5 Drawing Sheets

DISPLAY ARRANGEMENT

This invention relates to back-illuminated matrix displays that use rotatable light-shutters. Displays of this type are described in U.S. Pat. No. 4,163,332. This cited publication includes colour matrix which relies on differently coloured vanes, using four shutter to represent one picture element.

It is an object of the present invention to provide a back-illuminated display matrix having two modes of operation so as to make the display more useful, and more interesting or intriguing to the viewer. In particular, it is an object to make the display matrix switchable under computer control between a first mode in which the display is monochromatic and a second mode, which can be used to advantage at night, which is of lower resolution but which provides images in colour; this being achieved while keeping the structure of the matrix as simple as possible, and not altering the mechanism of the individual display elements from that required for only monochromatic display.

BRIEF DESCRIPTION OF THE DRAWINGS

FIGS. 1 and 2 illustrate a display system according to the invention. It comprises a display matrix 1 controlled by a computer 2. Matrix 1 has an array of display elements arranged as 36 rows by 120 columns for convenience of maintenance and fabrication, Matrix 1 comprises a number of such matrixes 6 butted side by side each 30 columns wide by 36 rows high. Each display element uses a single rotatable shutter vane as will be described presently. Matrix 1 can be switched under control of computer 2 so as to be in a high resolution monochromatic mode, illustrated in FIG. 1, in which it can display four lines of text using characters that are 7 display elements high by 5 wide. In this mode all the display elements forming the characters are of the same colour. Matrix 1 can alternatively be switched into a lower resolution mode illustrated in FIG. 2 which display only two lines of text using characters that are 14 display elements high by 10 wide but in which each of the characters can be independently programmed by computer 2 to have any one of up to 15 different colours. For example, character 3 can be red, character 4 green, character 5 orange and so son. The information displayed can alternatively be a picture, different parts of which have different colours, instead of writing.

Referring to FIGS. 3 and 4, display submatrix 6 includes a black front panel 10 perforated with apertures 11. Submatrix 6 is back-illuminated by lamps 18. Associated with each aperture 11 is a shutter vane 13 hinged about a horizontal axis 12 by means of hinge brackets 17. Shutter vane 13 has a brightly painted face 14, which is preferably florescent yellow, and a black face 15. All faces 14 in the matrix are of the same colour.

Figure 1:
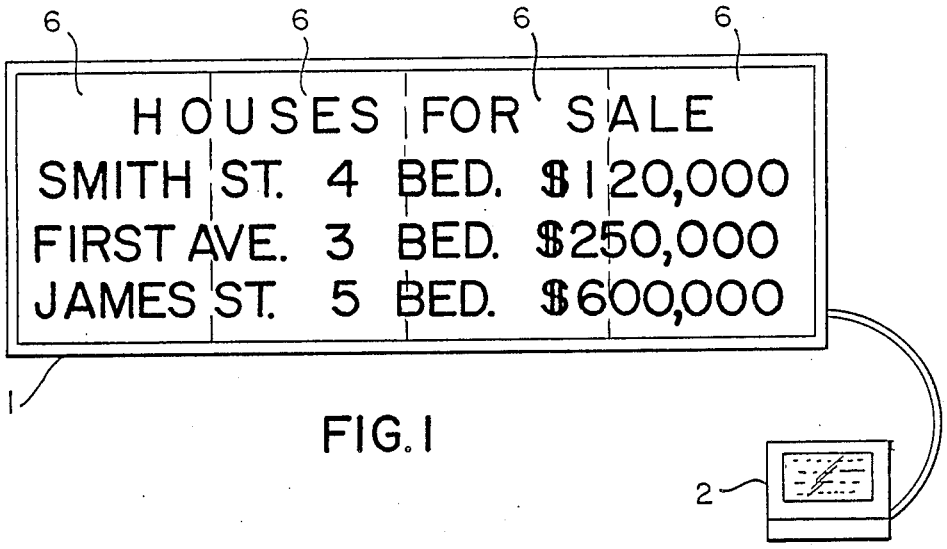
FIG. 1 illustrates an appearance of the display matrix when it is in the high resolution monochromatic mode.
Figure 2:
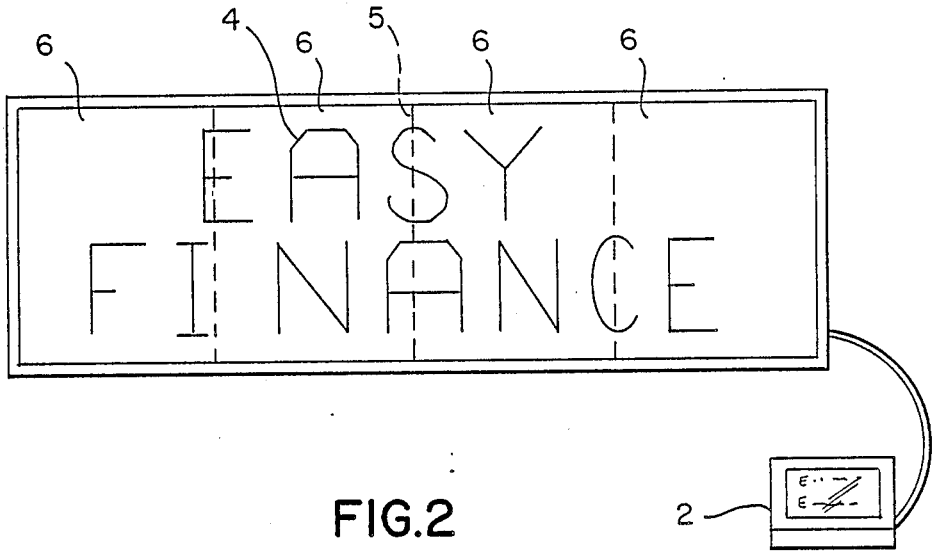
FIG. 2 illustrates an appearance of the display matrix when it is in the colour mode.

Each vane 13 carries a permanent magnet 16 having a magnetic axis normal to the plane of the vane. The south pole of magnet 16 faces the vane.

The display element consisting of vane 13 and its associated aperture 11 is set to its dark state by energising an electromagnet 20, which has a pole face 22 close to magnet 16, so that pole face 22 is a south pole. The display element is set to its bright state by opposite energisation. Electromagnets 20 are mounted on a transparent member 23 which is supported by means not shown. There can be one electromagnet for each vane 13 in the matrix, in which case all the vanes can be actuated simultaneously if required. Alternatively, there can be only one electromagnet for each horizontal row of vanes, in which case support member 23 is arranged for horizontal travel across the entire matrix so that the columns of shutter vanes 13 are actuated one after the other.

Figure 4:
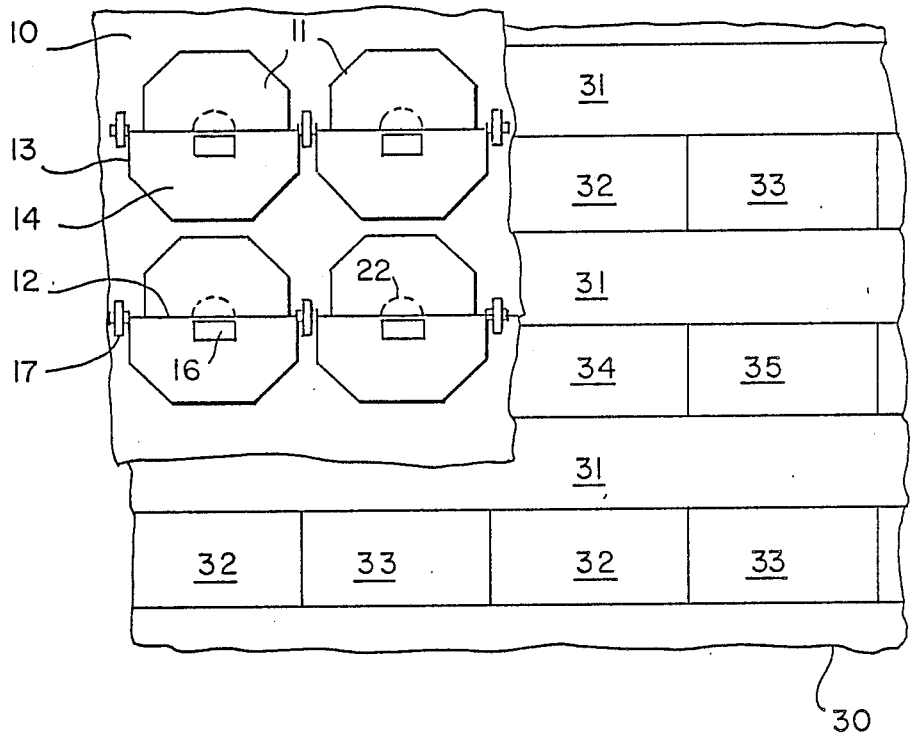
FIG. 4 is a front cut-away view of a portion of the display.

Mounted behind face panel 10 is a sheet 30 of light passing material onto which are printed regularly spaced bands 31 of translucent fluorescent ink, preferably of the same colour as faces 14 of the vanes. Bands 31 are both reflective and light transmissive. Interleaved with fluorescent bands 31 there are printed coloured rectangles. For each group of 2×2 display elements there are four rectangles 32, 33, 34, 35 of different colour from each other. For example 32, 33, 34, 35 can be green, blue, red and yellow respectively. These rectangles are preferably printed with translucent ink so as to be light diffusing. The set of four rectangles 32, 33, 34, 35 is repeated for every four display elements. Thus, there is a set of four rectangles behind the four display elements shown in FIG. 4.

Sheet 30 is arranged to be moved vertically by energisation of a solenoid 40 which is attached to panel 10 by means of a bracket 45. Energisation of solenoid 40 is under control of a bistable drive circuit not shown which is set and reset by computer 2. When solenoid 40 is energised it pulls up a sliding iron core 41 which in turn pulls up sheet 30, which is connected to core 41 by means of an arm 42 which is attached to core 41 and hooked into a hole 36 in sheet 30. The upper limit position of sheet 30 is determined by a rigid tongue 43 in bracket 45. When solenoid 40 is deenergised, sheet 30 is pulled down by spring means 46 to a lower limit position determined by a tongue 44 in bracket 45. Spring means 46 is hooked at one end into a hole 37 in sheet 30 and at the other end into a hole 47 in a bracket 48 which is attached to front panel 10. When sheet 30 is in the lower limit position, bands 31 are visible through apertures 11 and the matrix is monochromatic. When solenoid 40 is energised, there is for each set of 2×2 apertures a different one of the coloured rectangles 32, 33, 34, 35 behind each of the four apertures and the display is in the colour mode. When in this mode computer 2 controlling the matrix is arranged to treat each group of 2×2 display elements as one picture dot and to cause selected ones or combinations of the apertures within the set to be uncovered so as to give the picture dot, when viewed from a sufficiently large distance, a selected one or 15 different possible hues.

The high resolution monochromatic mode can be used at night and in the daytime. Its daytime appearance is brilliant even in direct sun light because of the reflectivity and fluorescence of bands 31 and faces 14. The colour mode is used at night, when the ambient lighting conditions do not interfere with the brightness and colour of the picture dots and faces 14 are invisible.

Figure 5:
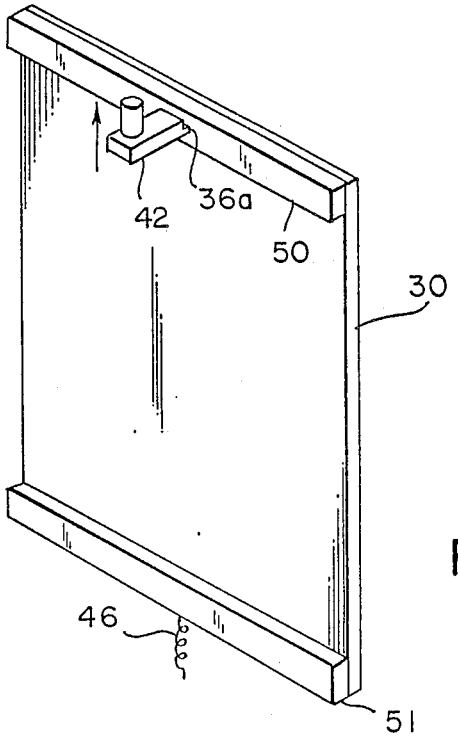
FIG. 5 is a perspective view of another embodiment of the invention.

Sheet 30 can be sufficiently thick so as not to be too floppy, for example of the order of 1 millimetre thick. Alternatively it can be much thinner by providing top and bottom support bars 50, 51 as illustrated in FIG. 5, each attached to sheet 30 all along its width. Actuating arm 42 is in this case fitted into hole 36*a* in support 50 for lifting sheet 30. Spring 46 is connected to the bottom of support bar 51. Of course, other means than the solenoid and return spring can be used for moving sheet 30 if desired.

Figure 3:
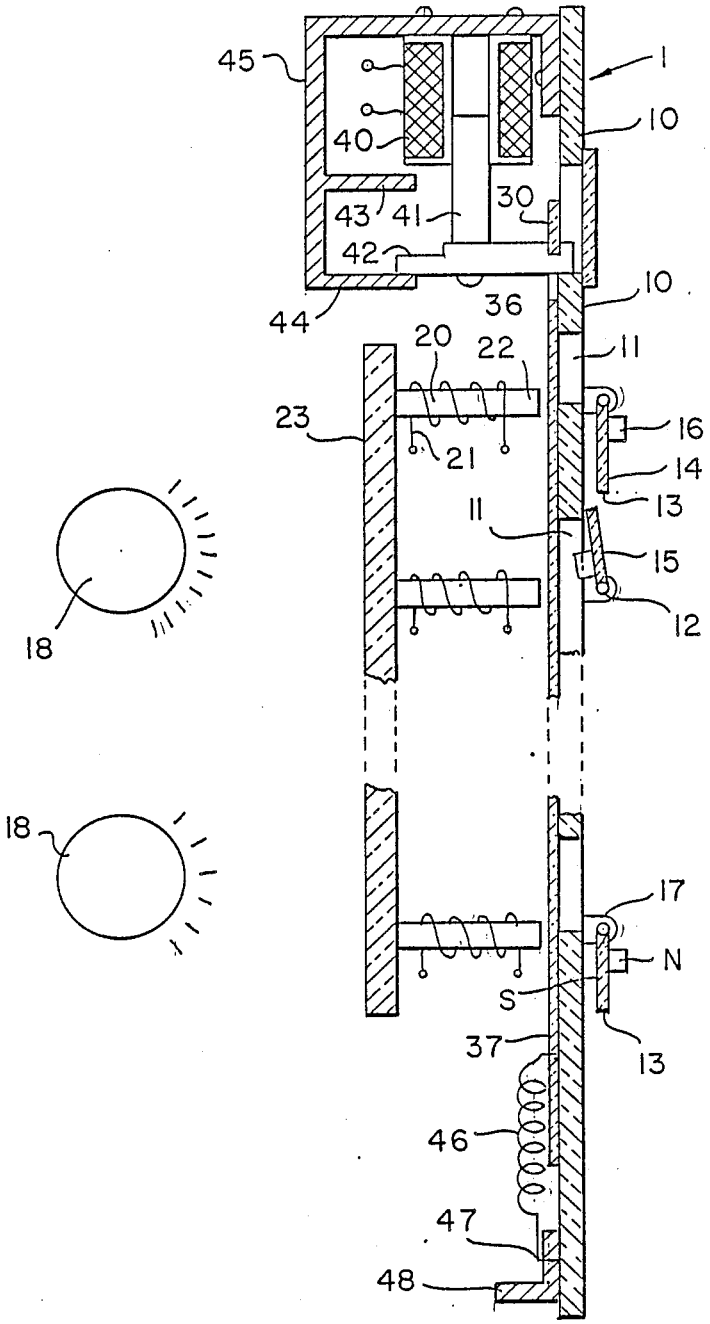
FIG. 3 is a cross sectional side view illustrating part of the display.
Figure 6:
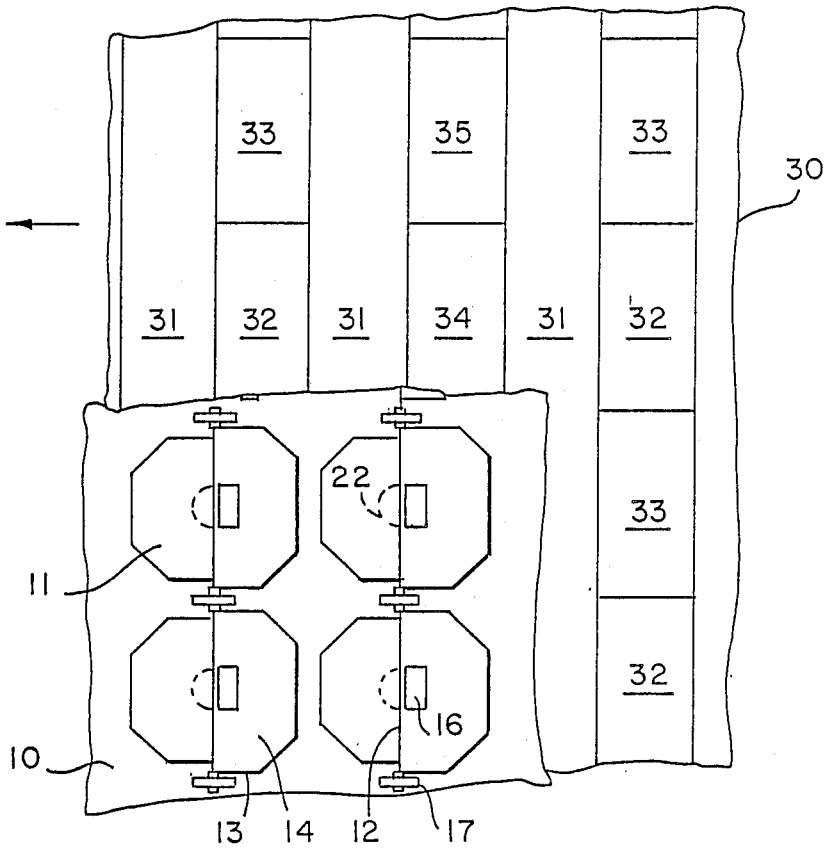
FIG. 6 is a cut-away view of a further embodiment of the invention.

Instead of having a vertically movable printed sheet 30 it is possible to have a horizontally movable one as illustrated in FIG. 6. In this case vanes 14 are arranged to rotate about vertical axes 12. The performance is the same. With sheet 30 as shown, the display is monochromatic. With sheet 30 moved to the left by a distance equal approximately to the width of vane 14, or half the distance between the rotational axes of adjacent columns, the display becomes a colour one. If the size of complete matrix 1 is not too large, for example if it is under two metres wide, matrix 1 can consist of a single panel 10 and a single sheet 30 serving all matrix 1, with a solenoid to pull sheet 30 to the left and a spring to return it to the right in a manner similar to that described with reference to FIG. 3.

The cost of incorporating the switchable colour feature into the basic monochromatic matrix or submatrix is very small, being basically the cost of a printed translucent sheet plus the solenoid and return spring arrangement.

I claim:

1. A display matrix having horizontal and vertical rows of display elements each including a magnetically operable shutter rotatable about an axis between a first position in which said display element appears dark and a second position in which it appears bright, said display matrix being arranged to be switchable between a first mode in which it appears monochromatic and a second mode of lower resolution in which it can display images of more than one color said display matrix including an opaque member having a group of light-passing areas each selectively coverable by a said shutter and including a light source common to several said display elements arranged to back-light the display elements and further including a sheet of light-passing material common to several said display elements said sheet having group of differently colored light-passing zones corresponding to said group of light passing areas said sheet being movable between a first location in which each of said light passing areas within the group has a different colored said zone opposite it and a second location wherein all of said display elements are identical to each other in color, said display matrix including actuating means connected with said common sheet arranged to move it from one to the other of said locations.

2. A display matrix according to claim 1 in which said sheet of light passing material is movable in a direction normal to said axis of rotation.

3. A display matrix according to claim 1 wherein said shutter comprises a vane brightly coloured on one face thereof and wherein said brightly coloured face is exposed to the viewer when said shutter is in the second position.

4. A display matrix according to claim 3 arranged so that when it is in the monochromatic mode each display element presents to the viewer, when it is in the bright state, a portion of said light passing sheet of the same colour as said brightly coloured face.

* * * * *